US006444953B1

(12) United States Patent
Leishman

(10) Patent No.: US 6,444,953 B1
(45) Date of Patent: Sep. 3, 2002

(54) AUTOMATIC RESTRICTED ACCESS CIGARETTE LIGHTER

(75) Inventor: Ronald George Leishman, Caboolture (AU)

(73) Assignee: Ladwyn Pty Limited, Caboolture (AU)

( * ) Notice: Subject to any disclaimer, the term of this patent is extended or adjusted under 35 U.S.C. 154(b) by 0 days.

(21) Appl. No.: 09/807,244

(22) PCT Filed: Oct. 13, 1999

(86) PCT No.: PCT/AU99/00876

§ 371 (c)(1),
(2), (4) Date: Apr. 10, 2001

(87) PCT Pub. No.: WO00/26579

PCT Pub. Date: May 11, 2000

(30) Foreign Application Priority Data

Nov. 2, 1998 (AU) ..... PP6876

(51) Int. Cl.[7] ..... F23Q 7/02; H05B 1/02
(52) U.S. Cl. ..... 219/269; 219/263; 219/267
(58) Field of Search ..... 219/269, 263, 219/260, 268, 267, 492

(56) References Cited

U.S. PATENT DOCUMENTS 1,844,206 A * 3/1932 Copeland ..... 219/267
3,354,291 A * 11/1967 Behrendt ..... 219/267
4,456,817 A * 6/1984 Mehnert et al. ..... 219/263
4,947,873 A * 8/1990 Wang ..... 131/329
5,275,180 A * 1/1994 Yeh ..... 219/267

FOREIGN PATENT DOCUMENTS

| | | | |
|---|---|---|---|
| DE | 2418011 | * 10/1975 | |
| FR | 1203030 | * 1/1960 | ..... 219/268 |
| FR | 1331466 | * 5/1963 | ..... 219/260 |
| FR | 1394723 | * 3/1965 | |
| FR | 2450419 | * 10/1980 | |
| JP | 58-122487 | * 7/1983 | |
| JP | 59-38528 | * 3/1984 | |
| JP | 5-248634 | * 9/1993 | |
| KR | 9820363 | * 1/1998 | |

* cited by examiner

*Primary Examiner*—John A. Jeffery
(74) *Attorney, Agent, or Firm*—Parsons & Goltry; Robert A. Parsons; Michael W. Goltry

(57) ABSTRACT

An automatic cigarette lighter comprises a thermal resistance element mounted in a sealed case and powered by a switch activated power supply. Operation of the thermal resistance element is controlled by a timer to heat for a predetermined time after activation of the switch and then to remain off for a predetermined period of time before reactivation is possible. The automatic cigarette lighter finds particular advantage in situations where naked flame is unsafe or undesirable. It is also useful in secure establishments, such as prisons.

16 Claims, 3 Drawing Sheets

AUTOMATIC RESTRICTED ACCESS CIGARETTE LIGHTER

FIELD OF THE INVENTION

THIS INVENTION relates to an automatic cigarette lighter for use in situations where it is unsafe to provide a naked flame. The invention provides particular application in prisons and psychiatric wards.

BACKGROUND OF THE INVENTION

It is an unfortunate fact of our modern society that it is necessary to incarcerate individuals who are deemed unfit for social contact. Incarceration occurs in special facilities such as prisons. For individuals who are mentally unfit, the incarceration may be psychiatric wards or other institutions.

Some of these individuals, especially those held in maximum security prisons, are so socially dysfunctional that they cannot be trusted with even rudimentary elements. In particular, it is common to deny these persons access to cigarette lighters and matches due to the probability of these items being put to improper use.

Nonetheless, society has determined that even maximum security prisoners have certain rights, including the right to smoke. It has therefore been necessary to give prisoners access to the means of lighting their cigarettes. Typically, this has meant that prison guards must carry cigarette lighters in order to allow prisoners the opportunity to smoke. This solution is generally unacceptable.

Another approach is to allow a trusted prisoner to carry a cigarette lighter. Prisoners wishing to smoke must approach the trusted prisoner to access the lighter. In order to retain privileges, the trusted prisoner must maintain control of the lighter at all times. Nonetheless, the potential for improper use of the lighter or match is great.

Although the above discussion has been directed to prisons and psychiatric wards, it will be appreciated that other situations requiring an automatic cigarette lighter will exist. It may be convenient to provide a device for the convenience of workers in installations having restrictions on open flames, such as an oil refinery. Office buildings with a smoke free policy may provide an automatic cigarette lighter outside the building for the convenience of workers in the building.

There is a clear need for a device that overcomes the problems described and which can be used in various situations.

OBJECT OF THE INVENTION

It is an object of the present invention to provide an automatic cigarette lighter that is safe for use by untrustworthy persons.

Further objects will be evident from the following description.

DISCLOSURE OF THE INVENTION

In one form, although it need not be the only or indeed the broadest form, the invention resides in an automatic cigarette lighter comprising:

- a case mounted in a wall;
- a thermal resistance element mounted with the case such that a cigarette may contact the thermal resistance element from a position external to the case;
- a switch activated power supply that provides power to the thermal resistance element; and

- a timer that controls the operation of the power supply to only supply power to the thermal resistance element for a predetermined period of time, and wherein a solenoid actuated shutter fitted to a front panel of said case, wherein said solenoid actuated shutter ptovides communication between the thermal edsistance element and a position external of the case, when said switch is activated.

The automatic cigarette lighter may also include an indication means, such as a light emitting diode, to indicate when the thermal resistance element is heating.

Preferably, the timer controls the operation of the power to only supply power to the thermal resistance element for a first predetermined period of time and prevents reactivation of the power supply for a second predetermined period of time after activation.

The thermal resistance element may suitably be joined to a flange which is in turn joined to a front panel of the case. An aperture in the front panel of the case provides communication between the thermal resistance element and a position external of the case.

The case is suitably waterproof and there is suitably a sealing means between the flange and the front panel of the case.

The automatic cigarette lighter may further comprise a ceramic cover over the thermal resistance means.

The automatic cigarette lighter may also further comprise a thermal switch that cuts power to the thermal resistance element if the thermal edsistance element exceeds a predetermined temperature.

BRIEF DESCRIPTION OF THE DRAWINGS

To assist in understanding the invention, preferred embodiments will now be described with reference to the following figures, in which.

DETAILED DESCRIPTION OF THE DRAWINGS

Figure 1:
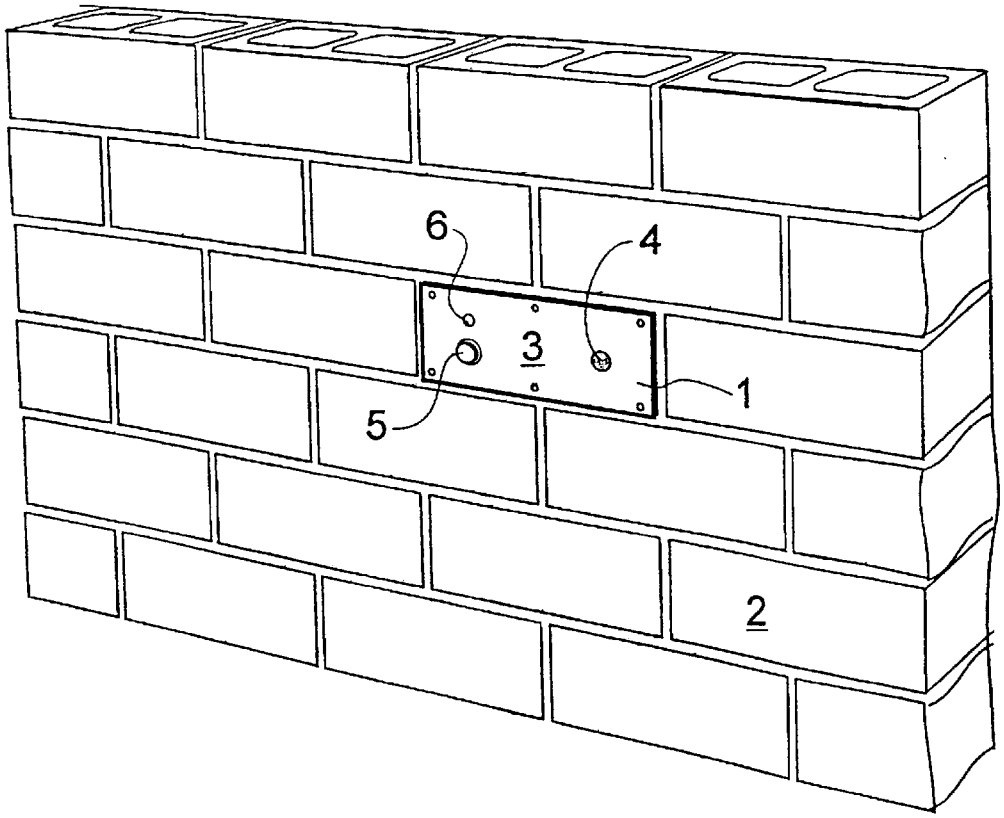
FIG. 1 is a schematic of an automatic cigarette lighter mounted in a wall of a prison cell.

In the drawings, like reference numerals refer to like parts. Referring to FIG. 1, there is shown an automatic cigarette lighter 1 mounted in a wall 2. The automatic cigarette lighter 1 includes a front panel 3 having an aperture 4 in which a cigarette to be lighted is inserted. A switch 5 is pressed to activate a thermal resistance element 9 that is heated to light the cigarette. A light emitting diode 6 provides an indication of when the automatic cigarette lighter 1 is in operation.

Figure 2:
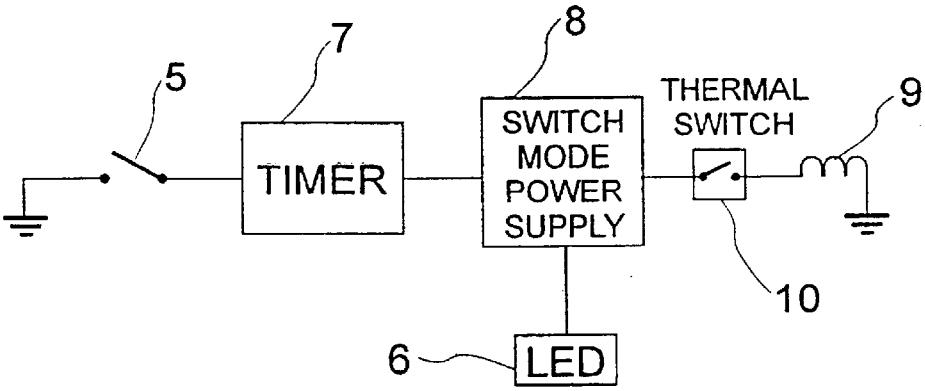
FIG. 2 is a circuit schematic of the automatic cigarette lighter.

The components of the automatic cigarette lighter 1 are shown schematically in FIG. 2. The switch 5 may be any suitable sealed switch unit. The inventor has found that a piezoelectric pressure switch is particularly suitable as it is completely sealed and has no moving parts.

Depression of the switch 5 activates a timer 7 that in turn activates a power supply 8 for a period of time determined by the timer 7. The inventor has determined that an appropriate timing cycle is to activate the power supply 8 for ten seconds and then prevent activation of the power supply for a further ten seconds. This timing cycle prevents overheating of the thermal resistance element 9.

A thermal switch 10 may also be employed, in the manner described below, to ensure that the thermal resistance element 9 cannot be burnt out.

The thermal resistance element 9 is a resistance coil that heats to a temperature sufficient to light a cigarette when a current is applied. A suitable thermal resistance element is a car cigarette lighter. If a car cigarette lighter is used, the power supply 8 is suitably a switch mode power supply generating outputs of 12 volts AC (or DC) to power the cigarette lighter and 5 volts DC to power the timer circuit. The circuits are described in more detail by reference to FIG. 4.

In order to withstand the abuses likely in a prison environment, the automatic cigarette lighter 1 must have a rugged construction. As mentioned above, this is achieved by mounting the automatic cigarette lighter in a wall and using a piezoelectric element as the on/off switch. The thermal resistance element 9 must also have a rugged construction.

Figure 3:
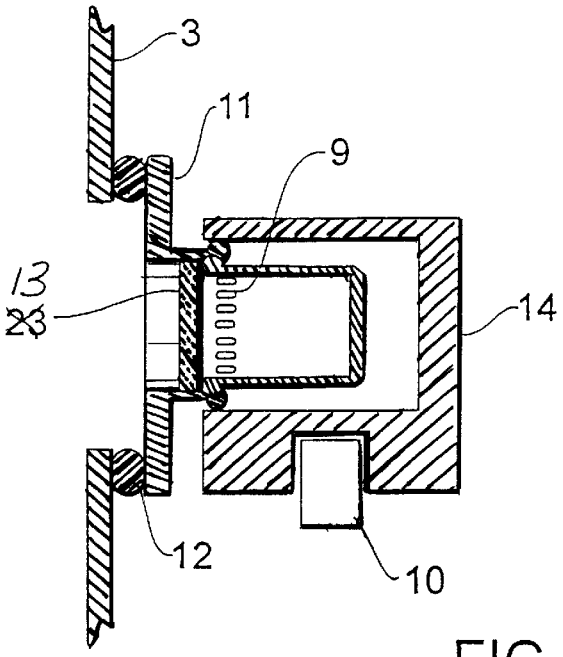
FIG. 3 is an enlarged view of the thermal resistance means and surrounding parts.

Referring now to FIG. 3, there is shown a thermal resistance element 9 in the form of a car cigarette lighter. The active element of a car cigarette lighter is a metal coil that glows hot when a current is applied at 12 volts AC (or DC). The thermal resistance element 9 is joined to a flange 11 which is in turn bolted to the front panel 3 of the automatic cigarette lighter 1.

A sealing ring 12 makes the device waterproof. It will be appreciated that damage could be caused to the device if the electronics became drenched in water or other fluid. Such an occurrence is considered to be most likely in a maximum security prison. Due to the low voltage employed, fluid in the thermal resistance element 9 is not considered to be a hazard or likely to lead to damage. Nonetheless, a ceramic cap 13 may be employed to protect the element. The ceramic cap may suitably be of the type commonly used with electric stove elements.

As mentioned above, a thermal switch 10 may be optionally employed to protect the thermal resistance element 9. The purpose of the thermal switch is to break the circuit if the temperature rises above a predetermined safe limit. To provide a suitable monitor of the temperature of the thermal resistance element, the inventor has found that it is convenient to mount the thermal switch in a heat sink 14, which is in turn mounted to substantially surround the thermal resistance element 9.

Figure 4:
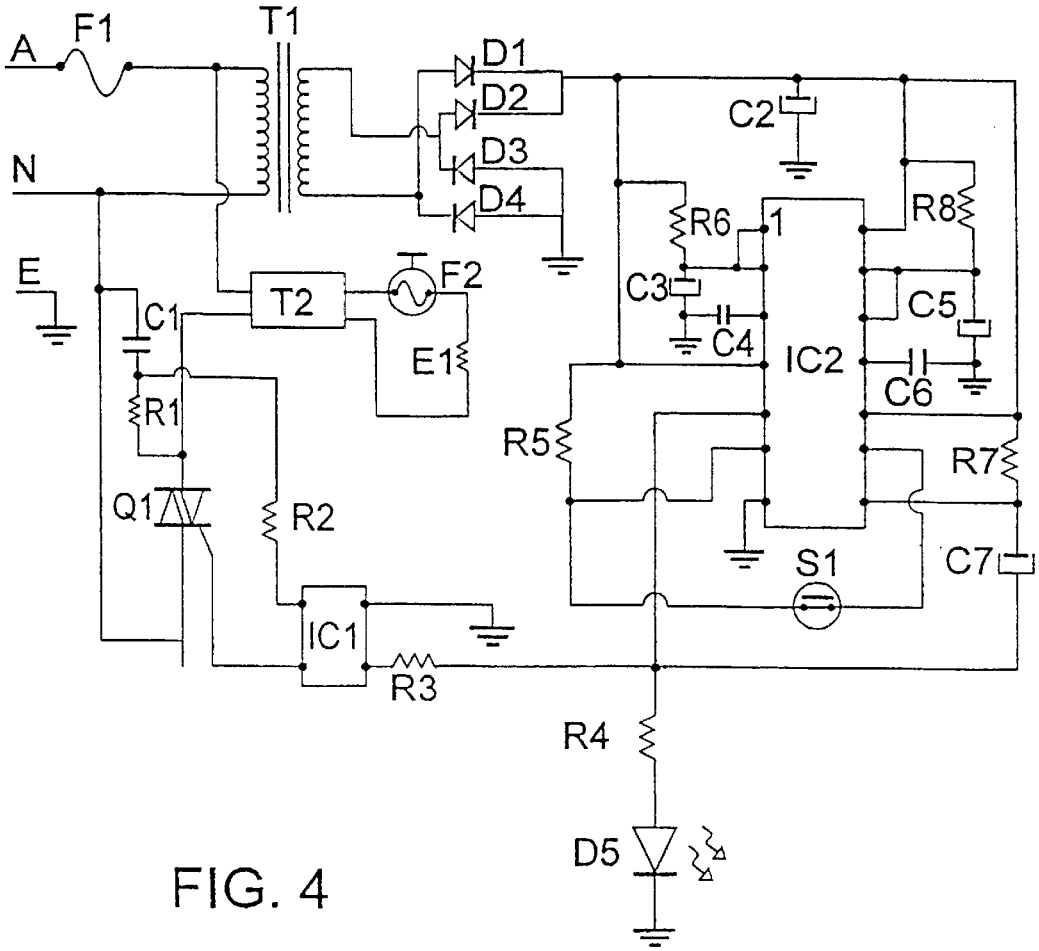
FIG. 4 is a circuit diagram for the automatic cigarette lighter.

One circuit suitable for working the automatic cigarette lighter is shown in FIG. 4. Mains power is provided on lines A (active) and N (neutral). The device is earthed at E. A 240V fuse F1 is provided on the active line. Transformer T1 provides a 5V output for driving the logic circuit and transformer T2 provides a 12V output to power the thermal resistance element E1. This part of the circuit is protected by thermal fuse F2 which is set to trip at 70° C. and is self-resetting. The thermal fuse is one form of thermal switch 10, described above.

Operation of the automatic cigarette lighter is indicated by illumination of red LED bezel D5, which is one form of the light emitting diode 6. The remainder of the circuit provides the timing described above. Table 1 lists a combination of components that the inventor has found to produce a satisfactory result.

TABLE 1

| | |
|---|---|
| C1 | .047 μ F, 600 V, poly |
| C2 | 330 μ F, 16 V, electro |
| C3 | 10 μ F, 25 V, electro |
| C4 | .01 μ F, 100 V, ceramic |
| C5 | 10 μ F, 25 V, electro |
| C6 | .01 μ F, 100 V, ceramic |
| C7 | 1 μ F, 63 V, electro |
| F1 | 2 A, 250 V |
| Q1 | BTB 08 600 C |
| IC1 | MCP3021 |
| IC2 | NE556 |
| R1 | 470Ω, 2W |
| R2 | 390Ω, 2W |
| R3 | 220Ω, ¼W |
| R4 | 1KΩ, ¼W |
| R5 | 10KΩ, ¼W |
| R6 | 1MΩ, ¼W |
| R7 | 10KΩ, ¼W |
| R8 | 1MΩ, ¼W |
| D1 | IN4007 |
| D2 | IN4007 |
| D3 | IN4007 |
| D4 | IN4007 |

The circuit of FIG. 4 can be easily modified to suit other power sources, such as a 24V or 12V battery. Other safety features can also be incorporated for particular situations. For example, in a prison situation, a number of automatic cigarette lighters could draw power from a single controllable power source. Smoking privileges could be withdrawn by deactivating one or a number of the automatic cigarette lighters.

Figure 5:
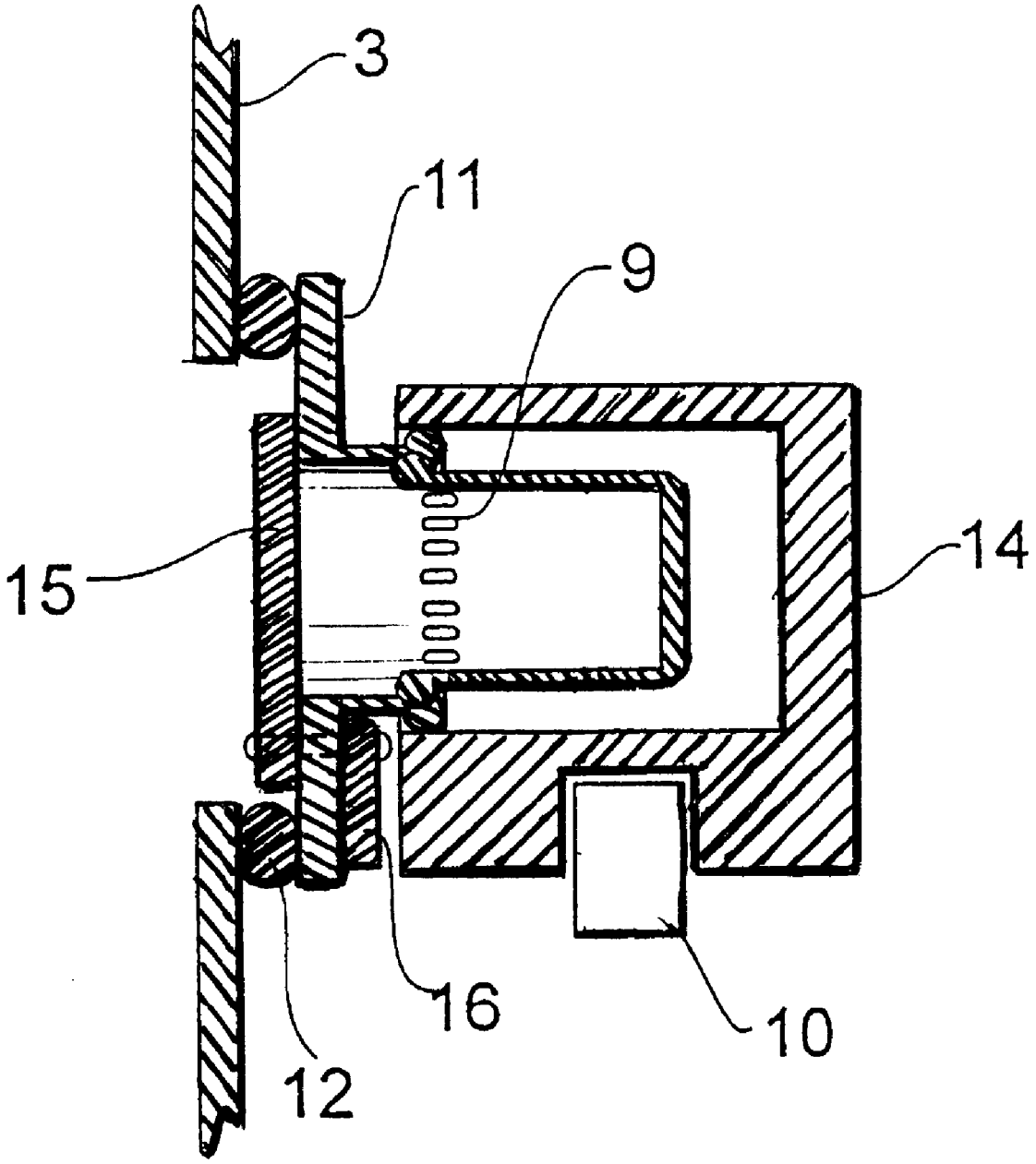
FIG. 5 is an enlarged view of a further embodiment of the automatic cigarette lighter.

The automatic cigarette lighter 1 could also be fitted with a shutter 15 across the aperture 4 as shown in FIG. 5. The shutter 15 is actuated by solenoid 16 when switch 5 is pushed. The shutter 15 can be deactivated to prevent access to the thermal resistance element 9.

It will be appreciated that the automatic cigarette lighter overcomes the safety problems associated with allowing prisoners or mentally disturbed persons to have access to cigarette lighters or matches. Yet the device allows the rights of the individual to smoke to be recognised and accepted. The device has a rugged construction to suit the situation in which it will be most commonly employed. It uses safety features to prevent overheating or other damage while still meeting the purpose of lighting a cigarette.

Throughout the specification the aim has been to described the preferred embodiments of the invention without limiting the invention to any one embodiment or specific collection of features.

What is claimed is:

1. An automatic cigarette lighter comprising:

a case mounted in a wall;

a thermal resistance element mounted within the case such that a cigarette may contact the thermal resistance element from a position external to the case;

a switch activated power supply that provides power to the thermal resistance element;

a timer that controls the operation of the power supply to only supply power to the thermal resistance element for a predetermined period of time; and wherein a solenoid actuated shutter fitted to a front panel of said case, wherein said solenoid actuated shutter provides communication between the thermal resistance element and a position external of the case, when said switch is activated.

2. The automatic cigarette lighter of claim 1 further comprising indicator means to indicate when the thermal resistance element is heating.

3. The automatic cigarette lighter to claim 2 wherein the indicator means is a light emitting diode.

4. The automatic cigarette lighter of claim 1 wherein the switch is a sealed switch unit.

5. The automatic cigarette lighter of claim 1 wherein the switch is a piezoelectric pressure switch.

6. The automatic cigarette lighter of claim 1 wherein the thermal resistance element is a thermal resistance coil.

7. The automatic cigarette lighter of claim 1 wherein the case comprises a front panel restricting access to the thermal resistance element, said panel including an aperture providing communication between the thermal resistance element and position external of the case.

8. The automatic cigarette lighter of claim 1 wherein the case is waterproof.

9. The automatic cigarette lighter of claim 1 wherein the thermal resistance element is attached to the front panel by a flange and there is a waterproof seal between the flange and the front panel.

10. The automatic cigarette lighter of claim 1 further comprising a ceramic cover over the thermal resistance element.

11. The automatic cigarette lighter of claim 1 further comprising a thermal switch that cuts power to the thermal resistance element if the thermal resistance element exceeds a predetermined temperature.

12. The automatic cigarette lighter of claim 11 wherein the thermal resistance element is housed in a heat sink and the thermal switch is mounted in the heat sink.

13. The automatic cigarette lighter of claim 1 further comprising a shutter that is actuated to prevent access to the thermal resistance element.

14. The automatic cigarette lighter of claim 1 wherein the power supply is a switch mode power supply.

15. The automatic cigarette lighter of claim 1 wherein the power supply is a battery.

16. An automatic cigarette lighter according to claim 1 wherein said timer controls the operation of the power to only supply power to the thermal resistance for a first predetermined period of time and prevents reactivation of the power supply for a second predetermined period of time after activation.

* * * * *